US005214936A

United States Patent [19]

Lim et al.

[11] Patent Number: 5,214,936

[45] Date of Patent: Jun. 1, 1993

[54] COOLING AIR SUPPLY DEVICE FOR A FREEZER COMPARTMENT

[75] Inventors: Jae H. Lim, Suweon; Myung W. Kim, Seoul; Gi J. Jeong, Suweon, all of Rep. of Korea

[73] Assignee: Samsung Electronics Co., Ltd., Suweon, Rep. of Korea

[21] Appl. No.: 767,887

[22] Filed: Sep. 30, 1991

[30] Foreign Application Priority Data

Sep. 28, 1990 [KR] Rep. of Korea ..... 90-15072[U]

[51] Int. Cl.[5] ..... F25D 17/04

[52] U.S. Cl. ..... 62/407; 62/416

[58] Field of Search ..... 62/404, 407, 408, 413, 62/414, 415, 416, 417, 419

[56] References Cited

U.S. PATENT DOCUMENTS

| | | | |
|---|---|---|---|
| 2,532,816 | 12/1950 | Kurtz | 62/419 |
| 2,696,086 | 12/1954 | Jones | 62/419 |
| 2,725,726 | 12/1955 | Swanson | 62/419 |
| 2,794,325 | 6/1957 | Shearer | 62/419 |
| 2,962,875 | 12/1960 | Barroero | 62/419 |
| 3,455,119 | 7/1969 | Bright | 62/408 |
| 4,671,074 | 6/1987 | Gostelow et al. | 62/186 |

FOREIGN PATENT DOCUMENTS

| | | |
|---|---|---|
| 62-45666 | 3/1987 | Japan . |
| 63-87490 | 7/1988 | Japan . |

*Primary Examiner*—Albert J. Makay
*Assistant Examiner*—William C. Doerrler
*Attorney, Agent, or Firm*—Burns, Doane, Swecker & Mathis

[57] ABSTRACT

The cooling air supply device of a refrigerating compartment comprises primary and secondary air supply devices positioned in the rear wall and the ceiling of the freezing compartment, respectively. The primary supply device has vertical flow dividers and horizontal flow dividers for venting the cooling air into the freezing compartment and a by-pass portion for feeding part of the air into the secondary supply device. The secondary supply device has channels along each side wall, and vents for venting some air downwardly and sidewardly and some air downwardly and forwardly.

10 Claims, 5 Drawing Sheets

COOLING AIR SUPPLY DEVICE FOR A FREEZER COMPARTMENT

BACKGROUND OF THE INVENTION

This invention relates to the improvement of a cooling air supply device having a plural air flow divider with fan forced circulation, and more particularly to the improvement of a cooling air supply device for a freezing compartment which evenly outflows the cooling air into the whole space of the freezing compartment.

In a conventional refrigerator cooling air supply device, the cooling air generated from an evaporator is circulated forcibly with a fan. The volume of the cooling air forcibly fed by the fan is controlled by a rib or plate in the duct for guiding the cooling air. The outflow is provided on the upper portion of the rear wall of the freezing compartment so as to feed the cooling air forward. On the other hand outflow is provided on the center portion of the ceiling of the freezing compartment so as to feed the cooling air downward. Such above typical structure is disclosed in detail in Japanese Utility Laid-Open applications No. 87490/1988 and No. 45666/1987. The prior art devices exhibit a problem in that the volume of the cooling air fed from the outflow grill is not dispersed through the whole space of the freezing compartment. This is especially a problem where the amount of stored food-stuffs in the freezing compartment prevents the cooling air fed from the upper center portion from circulating along the side wall, resulting in a large variation of temperature in the freezing compartment and poor freezing efficiency. The cooling air is not evenly distributed across the upper through the lower portion of the freezing compartment. Furthermore, when the freezing compartment is filled with food-stuffs, it is difficult for the air to be fed toward the door portion and the side wall portions. This results in the problem that temperature variation occurs between the center portion and the side wall portions of the freezing compartment.

SUMMARY OF THE INVENTION

In view of the foregoing problems, an object of the present invention is to provide a cooling air supply device which divides the cooling air into proper volumes to promote even temperature throughout the volume of the freezing compartment.

Another object of the present invention is to provide a cooling air supply device which enables a proper volume of cooling air to outflow along each side wall and the front portion of the freezing compartment to maintain an even freezing temperature in the freezing compartment in a proper volume.

According to the present invention, the cooling air supply device of a freezing compartment comprises a primary cooling air supply device and a secondary air supply device.

The primary cooling air supply device is positioned between a rear wall of the freezing compartment and an inner wall of the freezing compartment to guide cooling air toward a ceiling of the freezing compartment.

The secondary cooling air supply device is positioned in the ceiling to guide cooling air from the primary cooling air supply device toward a front area of the freezing compartment along channels formed in the secondary cooling air supply device.

Further, the primary cooling air supply device includes a plurality of vertical flow dividers which divided the cooling air and a plurality of horizontal flow dividers, which direct cooling air into the freezing compartment through a grill formed on the inner wall. The primary cooling air supply device also feeds cooling air toward the secondary cooling air supply device.

Further, the cooling air fed into the secondary cooling air supply device which encounters a left hand channel and a right hand channel which divide the cooling air fed from the primary cooling air supply device toward a left side wall and a right side wall of the freezing compartment, respectively.

The left hand channel and the right hand channel each include a sloping channel wall having a vent and a horizontal channel wall having a vent, respectively.

The sloping channel wall extends horizontally and is inclined downwardly toward the center of the freezing compartment, thereby venting the cooling air introduced therein toward a respective side wall of the freezing compartment.

The horizontal channel walls are each formed integrally at the front portion of each sloping channel and extend laterally outwardly therefrom, thereby venting the cooling air introduced therein toward a respective front side portion of the freezing compartment.

As a result of the above structure, part of the vertical flow cooling air in the primary cooling air supply device is vented in proper volumes to the lower and upper rear portions of the freezing compartment by the plurality of grills located therein. Also, part of the vertical flow is fed into the secondary cooling air supply device, and by the channels in the secondary cooling air supply device, the cooling air is vented in proper volumes into the rear and front of each side portion of the freezing compartment.

Therefore, the cooling air is outflowed or vented evenly throughout the whole space of the freezing compartment.

DESCRIPTION OF THE PREFERRED EMBODIMENT

Figure 1:
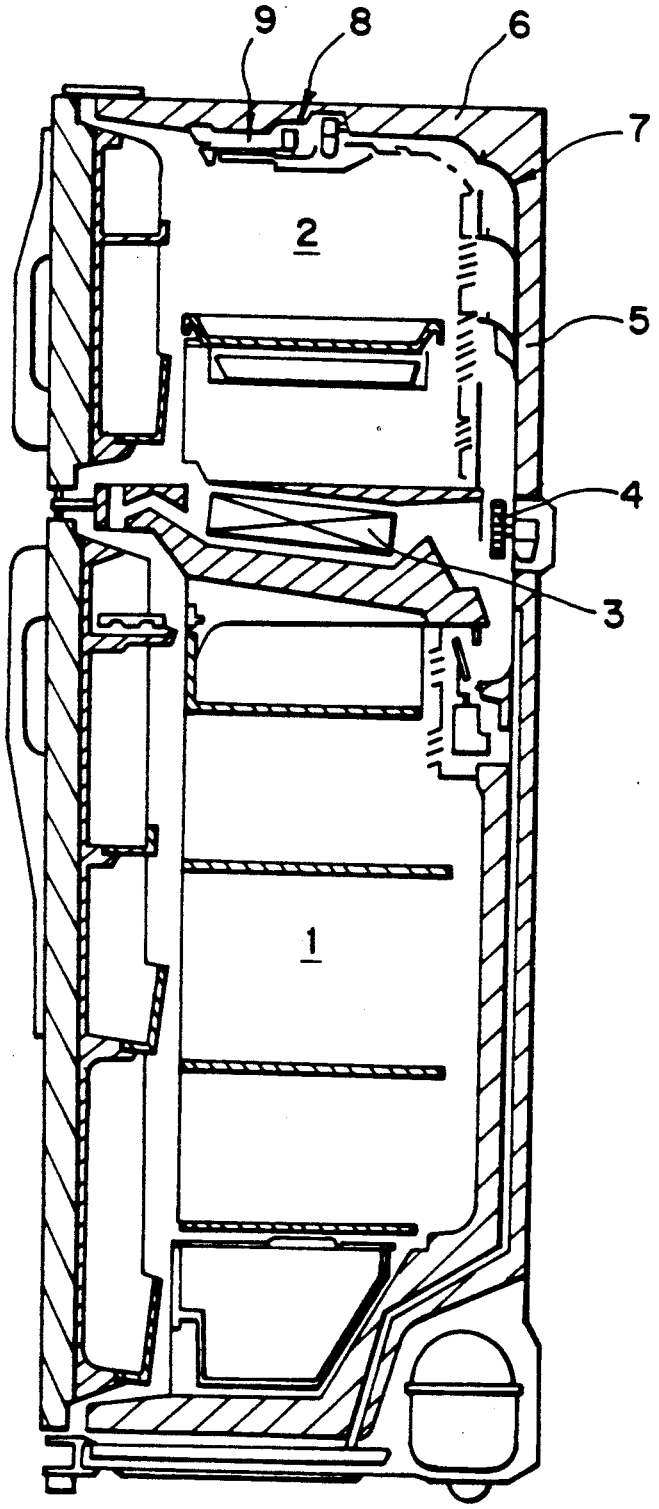
FIG. 1 is a vertical sectional view through a refrigerator having the cooling air supply device of the present invention.

FIG. 1 illustrates a refrigerator with a refrigerating compartment 1, a freezing compartment 2 and an evaporator 3 positioned therebetween. Fan 4 is mounted in the rear wall 5 of the refrigerator. The primary cooling air supply device 7 extends to the ceiling 6 along the rear wall 5. At the front area close to a door of the freezing compartment a control apparatus 8 is installed so as to control the temperature of the freezing compartment. A secondary cooling air supply device 9 is positioned proximate the control apparatus 8.

Figure 2:
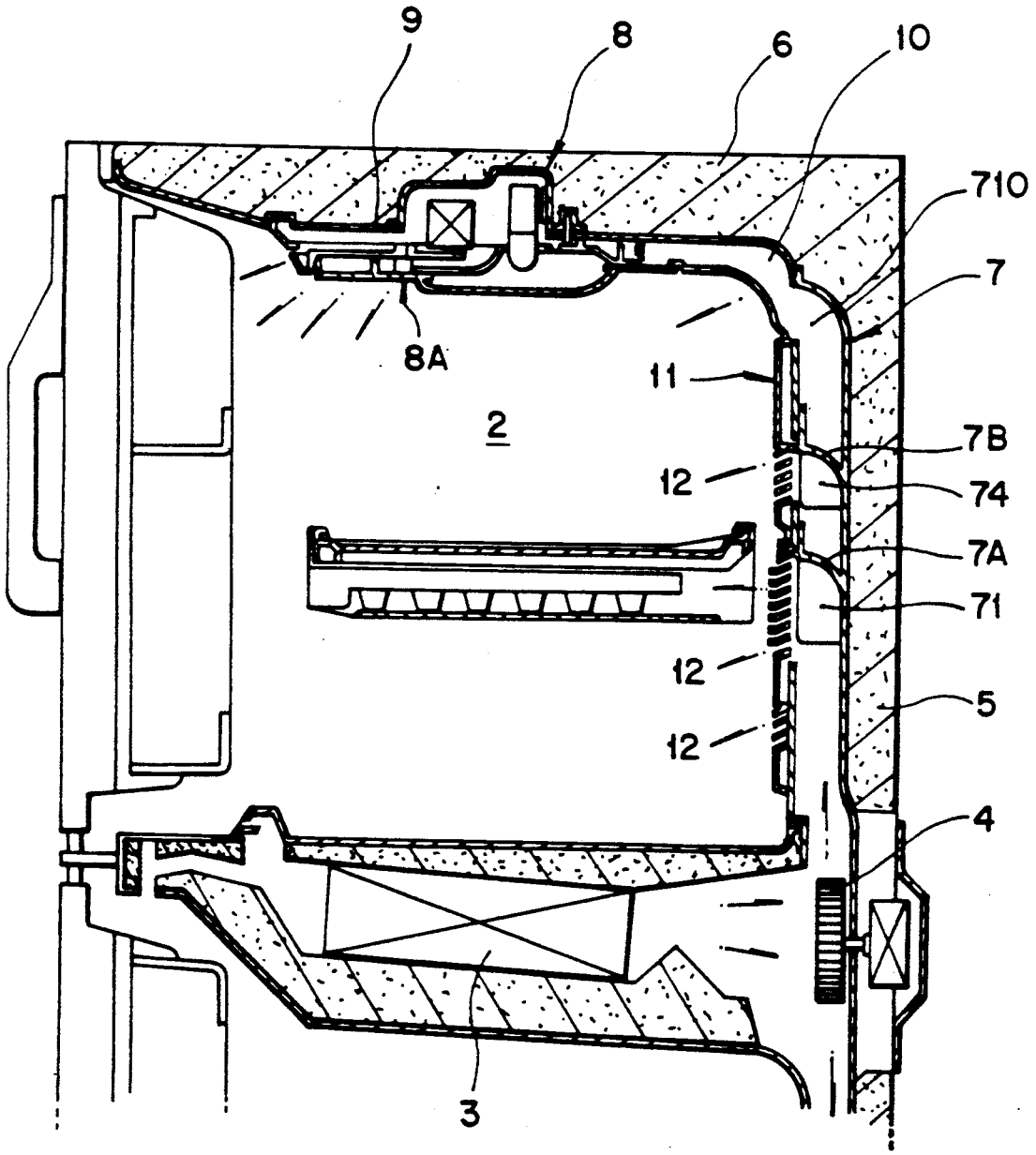
FIG. 2 is an enlarged vertical sectional view of the cooling air supply device for the freezing compartment according to the present invention.

The cooling air supply device 7 for the freezing compartment 2 is shown in FIG. 2. The inner wall 11 is spaced apart a certain distance from the rear wall 5.

Between the inner wall 11 and the rear wall 5, the primary cooling air supply device 7 is positioned. On the inner wall 11 a plurality of grills 12 are formed so as to vent the cooling air in the primary cooling air supply device 7 into the freezing compartment 2. The cooling air passage 10 ducts cooling air from a by-pass or terminal portion 710 of the primary cooling air supply device 7 toward the ceiling 6 and the rear portion of the case 8A which is one member of the control apparatus 8. The passage 10 is extended from the terminal portion 710 to the rear portion of the case 8A. The secondary cooling air supply device 9 is formed on each side of the case 8A at a front portion of the case 8A. The control apparatus 8 is the apparatus of the refrigerator is disclosed in Korean Utility Model Application No. 90-14088, filed Sep. 12, 1990 by the present inventor as that of the present invention. Other such control apparatus are known in the art and do not form part of the present invention.

Figure 3:
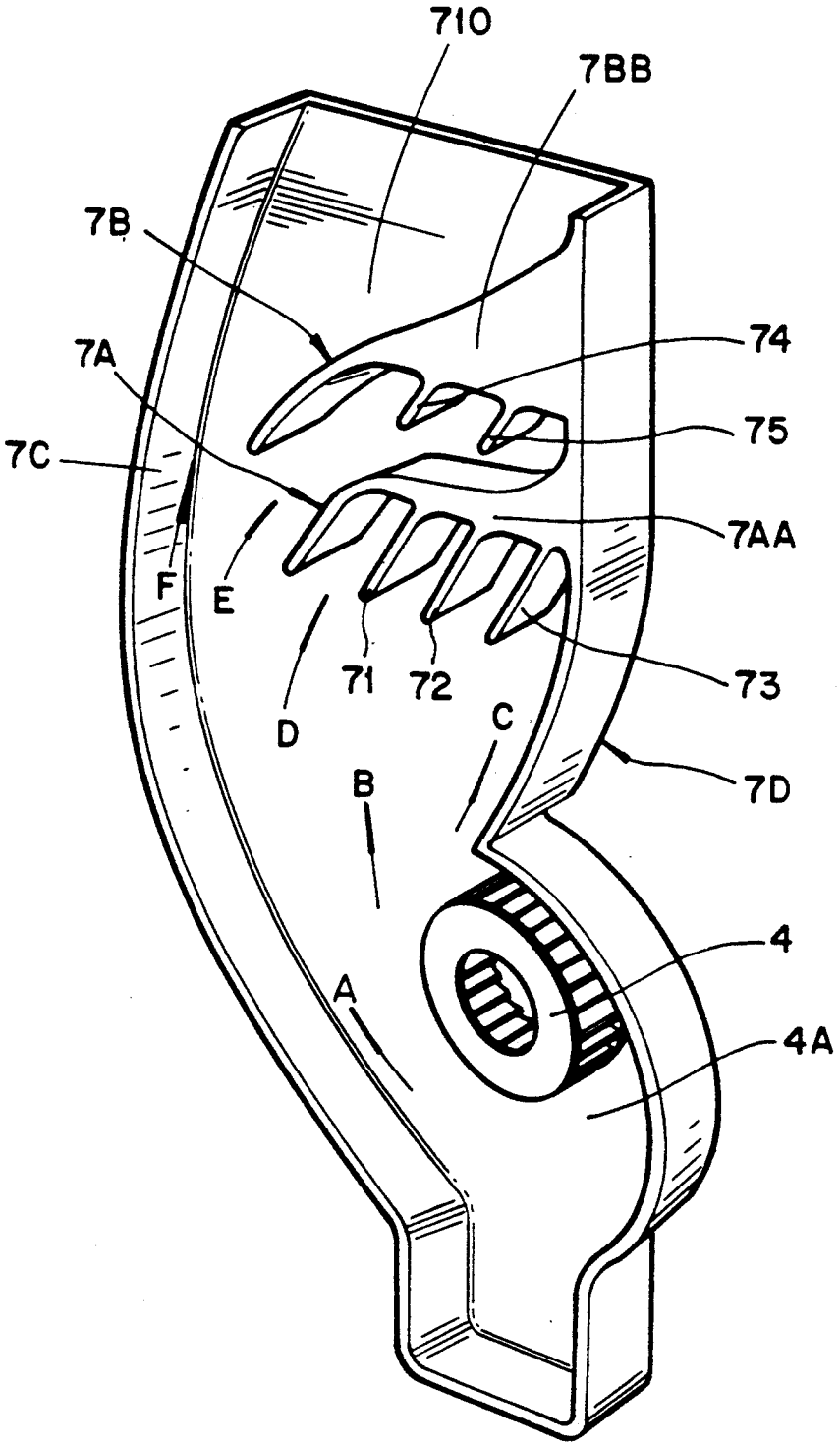
FIG. 3 is a perspective view of the primary cooling air supply device of the present invention.

FIG. 3 is a perspective view of the primary cooling air supply device 7. The primary cooling air supply device 7 comprises a first guide wall 7C and a second guide wall 7D. The walls duct the cooling air flowing from an intaking chamber 4A encircling part of the fan 4 to the freezing compartment 2. Vertical flow divider 7A is mounted on the second guide wall 7D at a predetermined distance from the center of the fan 4. Vertical flow divider 7B is mounted at a next upper portion adjacent the vertical flow divider 7A. The vertical flow dividers 7A, 7B divide the main flow of cooling air (depicted as arrow A) feeding along the first guide wall 7C into sub-flows D, E, F of cooling air. Horizontal flow dividers 71, 72 and 73 are respectively formed integral with at a main frame 7AA of the vertical flow divider 7A in the shape of ribs. The horizontal flow dividers 71,72 and 73 divided the part B of the main flow cooling air. The distance between the horizontal flow dividers 71,72 and 73, as well as the respective configuration thereof are determined in accordance with the velocity of the cooling air fed therein. Moreover, horizontal flow dividers 74 and 75 are respectively formed integral with a main frame 7BB of the vertical flow divider 7B in the shape of ribs. The horizontal flow dividers 74 and 75 divide the part E of the main flow cooling air. The distance between the horizontal flow dividers 74 and 75, as well as the respective configuration thereof are determined in accordance with the velocity of the cooling air fed therein. In this embodiment, a number of the horizontal flow dividers 71,72,73 in the vertical flow divider 7A are more than that of the horizontal dividers 74,75 in the vertical flow divider 7B. Another vertical flow divider may be installed in a terminating flow portion 710 for feeding the part of the main flow F of cooling air to the cooling air passage 10. Further, a grill 12 is installed for each cooling air flow which is diverted by the vertical flow divider and the horizontal flow divider.

Figure 4:
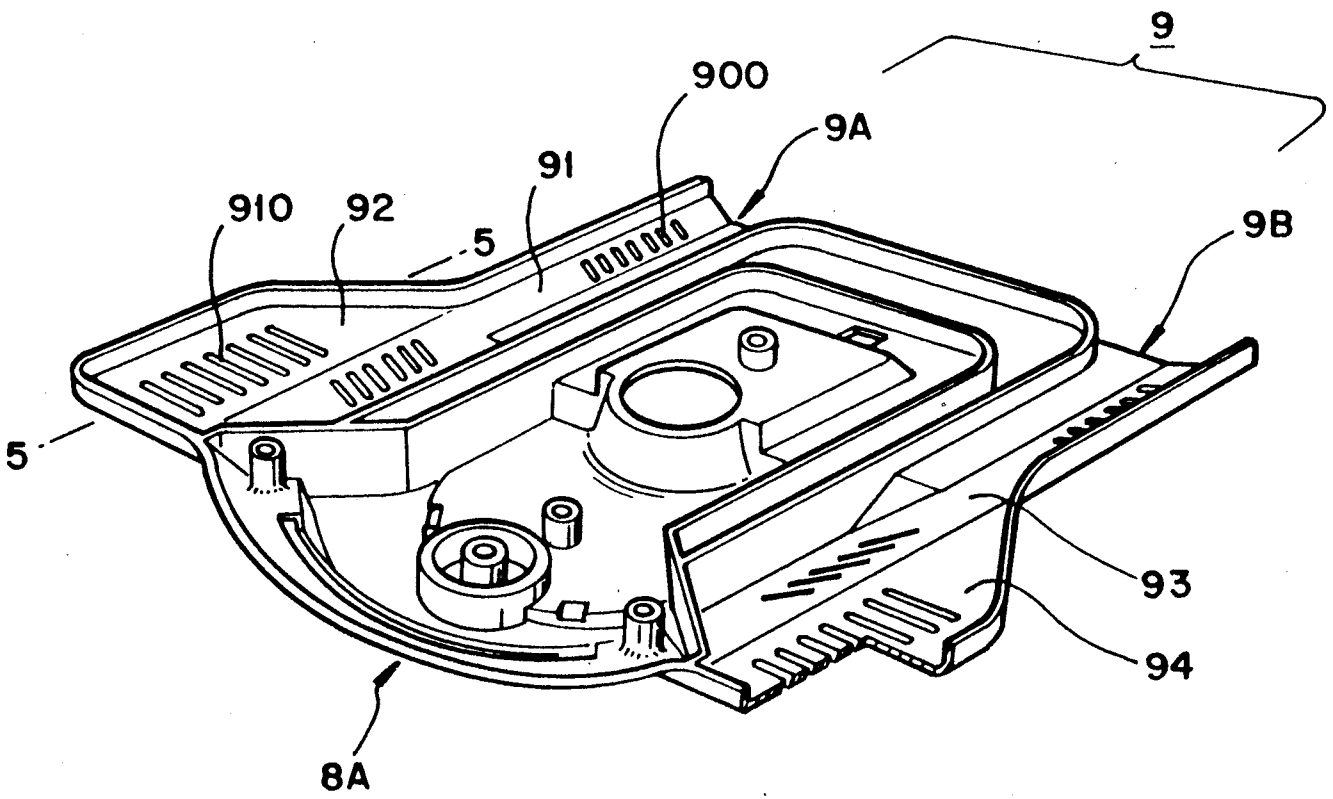
FIG. 4 is a perspective view of the secondary cooling air supply device of the present invention.
Figure 5:
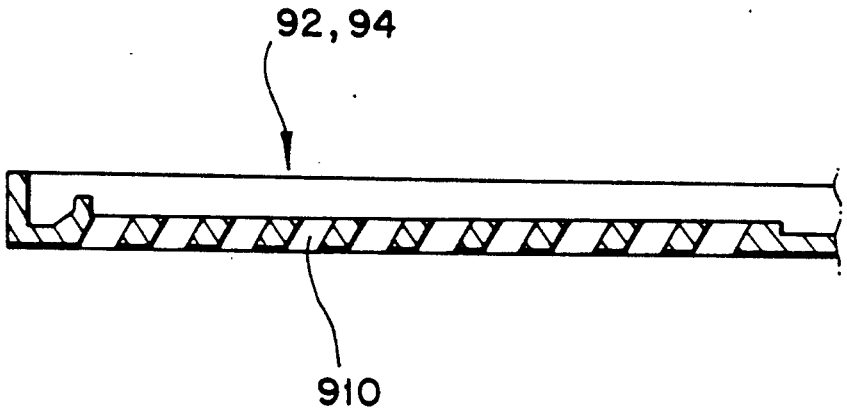
FIG. 5 is a sectional view of the vent of the horizontal channel taken along line 5—5 of the FIG. 4.

FIG. 4 is a perspective view of the secondary cooling air supply device 9. The secondary cooling air supply device 9 comprises a left hand channel 9A and a right hand channel 9B. The left hand forked channel 9A is formed at a left side of the case 8A and extends toward the front portion of the case 8A. In the same manner the right hand forked channel 9B is formed at a right side of the case 8A. The left hand forked channel 9A includes a sloping channel wall 91 and a horizontal channel wall 92. The right hand forked channel 9B includes a sloping channel wall 93 and a horizontal channel wall 94. The sloping channel wall 91 extends to the front portion of the case 8A from the rear portion of the case 8A. The sloping channel wall 91 faces to the left side wall (not shown) of the refrigerator. The horizontal channel 92 is formed integrally with an laterally outwardly of the the front portion of the sloping channel 91, and extends toward the front side portion of the freezing compartment. On the sloping channel wall 91 there is disposed a vent 900 comprised of a plurality of holes is formed perpendicularly to the sloped surface so as to feed the cooling air into the lower portion of the left side of the freezing compartment. On the horizontal channel wall 92 there is provided a vent 910 having a plurality of holes is formed to extend toward the front portion of the freezing compartment so as to feed cooling air into the front portion of the freezing compartment. The sloping channel wall 93 and the horizontal wall 94 are formed adjacent the right side wall of the freezing compartment, just as the sloping channel wall 91 and the horizontal wall 92 are formed adjacent the left side wall of the freezing compartment and have corresponding vents. Furthermore, the vents 910 of the horizontal flow channel walls 92,94 may be inclined toward the front portion of the freezing compartment as illustrated in FIG. 5.

The cooling air control device operates as follows, with reference to FIGS. 2,3 and 4.

The cooling air generated in the evaporator 3 is forced by the fan 4 to flow up as flows A,B and C, across the primary cooling air flow a traveling supply device 7. The cooling air along the first guide wall 7C is divided into flows D, E and F of prescribed volumes by the vertical flow dividers 7A,7B. The cooling air flows B, C and D are acted upon by the vertical flow divider 7A and are subdivided by the horizontal flow dividers 71, 72 and 73 into prescribed volumes. The sub-divided cooling air is directed by the main frame 7AA into the freezing compartment 2 through the grill 12. Further, the cooling air flow E is sub-divided by the horizontal flow dividers 74, 75 into prescribed volumes. That sub-divided cooling air is directed by the main frame 7BB into the freezing compartment 2 through another grill 12. The cooling air flow F is conducted by the terminating flow portion 710 to the air passage 10 and then to the control apparatus 8 across the ceiling 6. The cooling air flow F is divided into the left hand channel 9A and the right hand channel 9B. The cooling air fed in the left hand channel 9A is vented through the vent 900 to the lower portion of the left side of the freezing compartment 2. Through the vent 910 the cooling air is vented to the front left portion of the freezing compartment 2. Simultaneously, the cooling air in the right hand channel 9B is vented to the lower portion of the right side and the front right portion of the freezing compartment 2.

What is claimed is:

1. A freezer including a freezer compartment formed by upstanding walls and a ceiling, and means for directing cooling air into said freezer compartment comprising:

primary cooling air supply means located along an upstanding wall for vertically and horizontally subdividing a first portion of the cooling air, said primary cooling air supply means including a first divider for receiving a first amount of said first cooling air portion, and at least one second divider located above and downstream of said first divider for receiving a second amount of said first cooling air portion, each of said first and second dividers including means for horizontally subdividing said respective first and second amounts, each of said dividers including a generally horizontally extending portion and a plurality of horizontally spaced, downwardly depending ribs, said generally horizontally extending portion of said second divider extending horizontally past said generally horizontally extending portion of said first divider for receiving cooling air traveling past said first divider, said first divider having more ribs than said second divider, primary vent means for receiving the vertically and horizontally divided cooling air from said primary cooling air supply means and venting same into said freezer compartment through said rear wall; and secondary cooling air supply means for receiving a second portion of the cooling air and including horizontally spaced, forwardly extending channels for receiving some of said second cooling air portion, each of said channels including secondary vent means for directing said second cooling air portion downwardly into said freezer compartment as said second cooling air portion travels forwardly along said channels.

2. A freezer according to claim 1, wherein said upstanding walls include a rear wall, a front wall, and two side walls, said primary cooling air supply means and said primary vent means being disposed on said rear wall, said secondary cooling air supply means being disposed on said ceiling.

3. A freezer according to claim 1, wherein said primary cooling air supply means includes by-pass means through which said second cooling air portion travels toward said secondary cooling air supply means.

4. A freezer including a freezer compartment formed by upstanding walls and a ceiling, and means for directing cooling air into said freezer compartment comprising:

primary cooling air supply means located along an upstanding wall for vertically and horizontally subdividing a first portion of the cooling air;

primary vent means for receiving the vertically and horizontally divided cooling air from said primary cooling air supply means and venting same into said freezer compartment through said rear wall; and secondary cooling air supply means for receiving a second portion of the cooling air and including horizontally spaced, forwardly extending channels for receiving some of said second cooling air portion, each of said channels including secondary vent means for directing said second cooling air portion downwardly into said freezer compartment as said second cooling air portion travels forwardly along said channels, said vent means including first vents oriented to direct cooling air downwardly and sidewardly, and second vents disposed forwardly of said first vents.

5. A freezer according to claim 4, wherein said first vents are formed in a wall of a respective channel which is inclined relative to vertical.

6. A freezer according to claim 4, wherein said second vents are arranged to direct cooling air downwardly and forwardly.

7. A freezer comprising a freezer compartment formed by front and rear walls, two side walls, and a ceiling, and means for directing cooling air into said freezer compartment comprising:

primary cooling air supply means disposed in said rear wall for receiving a first portion of said cooling air and including vertically spaced dividers, each of said dividers including horizontally spaced ribs, whereby said dividers vertically and horizontally divide said first cooling air portion;

primary vent means formed in an inner section of said rear wall for venting said first cooling air portion from said primary cooling air supply means into said freezer compartment; and secondary cooling air supply means mounted on said ceiling and arranged to receive a second portion of said cooling air which by-passes said dividers, said secondary cooling air supply means including horizontally spaced, forwardly extending channels for conducting said second cooling portion, each of said channels including secondary vents for conducting cooling air downwardly and sidewardly.

8. A freezer according to claim 7, wherein a downstream one of said dividers extends horizontally past an end of an upstream one of said dividers to receive cooling air traveling past said end.

9. A freezer according to claim 8, wherein some of said secondary vents are formed in an inclined wall of said channel, said inclined wall facing downwardly toward a respective side wall of said freezer compartment.

10. A freezer according to claim 9, wherein others of said secondary vents are arranged to direct air downwardly and forwardly.

* * * * *